US005622485A

United States Patent [19]

Stewart

[11] Patent Number: 5,622,485

[45] Date of Patent: Apr. 22, 1997

[54] HIGH PERFORMANCE EFFICIENCY DIRTY AIR MOTOR/FAN SYSTEM

[75] Inventor: Timothy J. Stewart, Akron, Ohio

[73] Assignee: Ametek, Inc., Kent, Ohio

[21] Appl. No.: 508,224

[22] Filed: Jul. 27, 1995

[51] Int. Cl.[6] ..... F04B 35/04

[52] U.S. Cl. ..... 417/423.2; 417/423.14; 417/423.15; 248/300

[58] Field of Search ..... 417/423.2, 423.8, 417/423.14, 423.15, 360; 248/300, 603, 674; 415/213.1

[56] References Cited

U.S. PATENT DOCUMENTS

| | | | |
|---|---|---|---|
| 4,093,168 | 6/1978 | Buril | 248/300 |
| 5,044,883 | 9/1991 | Neuder | 417/423.15 |
| 5,060,906 | 10/1991 | Gayle | 248/300 |
| 5,066,193 | 11/1991 | Travanti Corinti et al. | 415/213.1 |
| 5,110,266 | 5/1992 | Toyoshima et al. | 417/423.3 |
| 5,195,710 | 3/1993 | Remblier | 248/300 |
| 5,375,651 | 12/1994 | Colwell | 417/423.3 |

*Primary Examiner*—Charles G. Freay
*Attorney, Agent, or Firm*—Renner, Kenner, Greive, Bobak, Taylor & Weber

[57] ABSTRACT

A high-performance, high efficiency dirty air motor/fan assembly for vacuum cleaners has a fan housing which includes an end bracket. The end bracket has a volute expansion chamber. A shroud/baffle unit mounts to the end bracket and serves to separate the exhaust plenum of the ventilating fan of the motor, from the intake plenum. A component mounting strap is mounted to the housing and the shroud/baffle unit to provide a mounting surface for vacuum cleaner interfaces.

13 Claims, 3 Drawing Sheets

HIGH PERFORMANCE EFFICIENCY DIRTY AIR MOTOR/FAN SYSTEM

TECHNICAL FIELD

The invention herein resides in the art of motor/fan systems. More particularly, the invention relates to such motor/fan systems which are used in dirty air environments such as in vacuum cleaners. Specifically, the invention relates to the housing ventilating shroud/baffle and component strap for such systems.

BACKGROUND ART

Historically, motor/fan systems used in vacuum cleaners have been compromised by the inability to increase fan performance without sacrificing the debris ingestion capability thereof. Further, the ventilation fans of such known systems have their inlet and exhaust plenums in relatively close proximity, resulting in less than optimal motor component cooling. Accordingly, the life span and overall reliability of the motor components is also less than optimal.

Typically, vacuum cleaner interfaces, such as switches and power receptacles, are mounted on the cleaner assembly. As such, manufacturing and assembly of the motor fan assembly to the cleaner assembly is both labor intensive and expensive due to the numerous connections required.

Thus, it is desired to obtain a flexible integrated, and easily assembled fan/motor assembly for vacuum cleaners, and the like, which has increased fan performance without a corresponding decrease in debris ingestion capability while running cooler and more reliably.

DISCLOSURE OF THE INVENTION

In light of the foregoing, it is a first aspect of the invention to provide a motor/fan assembly for vacuum cleaners and the like.

Another aspect of the invention is the provision of a motor/fan assembly which has increased working fan efficiency without sacrificing debris ingestion capability.

A further aspect of the invention is the provision of a motor/fan assembly which has a high degree of flexibility for alternate power components.

Yet another aspect of the invention is the provision of a of motor/fan assembly which is capable of being easily and inexpensively manufactured using known techniques and equipment.

The foregoing and other aspects of the invention which will become apparent as the detailed description proceeds are achieved by an improved motor/fan assembly for vacuum cleaners or the like, the assembly having a rotating fan member mounted in a housing, and a motor having a ventilating fan, the motor being engaged with the rotating fan, the improvement comprising: an end bracket portion of the housing, said end bracket having a volute expansion chamber; a shroud/baffle unit interposed between the motor and said end bracket, and surrounding the motor; and a component strap mounted to said shroud/baffle unit and said end bracket; whereby said shroud/baffle unit serves to separate the intake and exhaust plenums of the ventilation fan, and said component strap serves as a mounting surface for vacuum cleaner interfaces.

Other aspects of the invention which will become apparent herein are achieved by a component mounting strap for a motor/fan assembly, comprising: at least one mounting flange; at least one side wall extending obliquely from said at least one mounting flange; and at least one component mounting aperture in said at least one sidewall.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
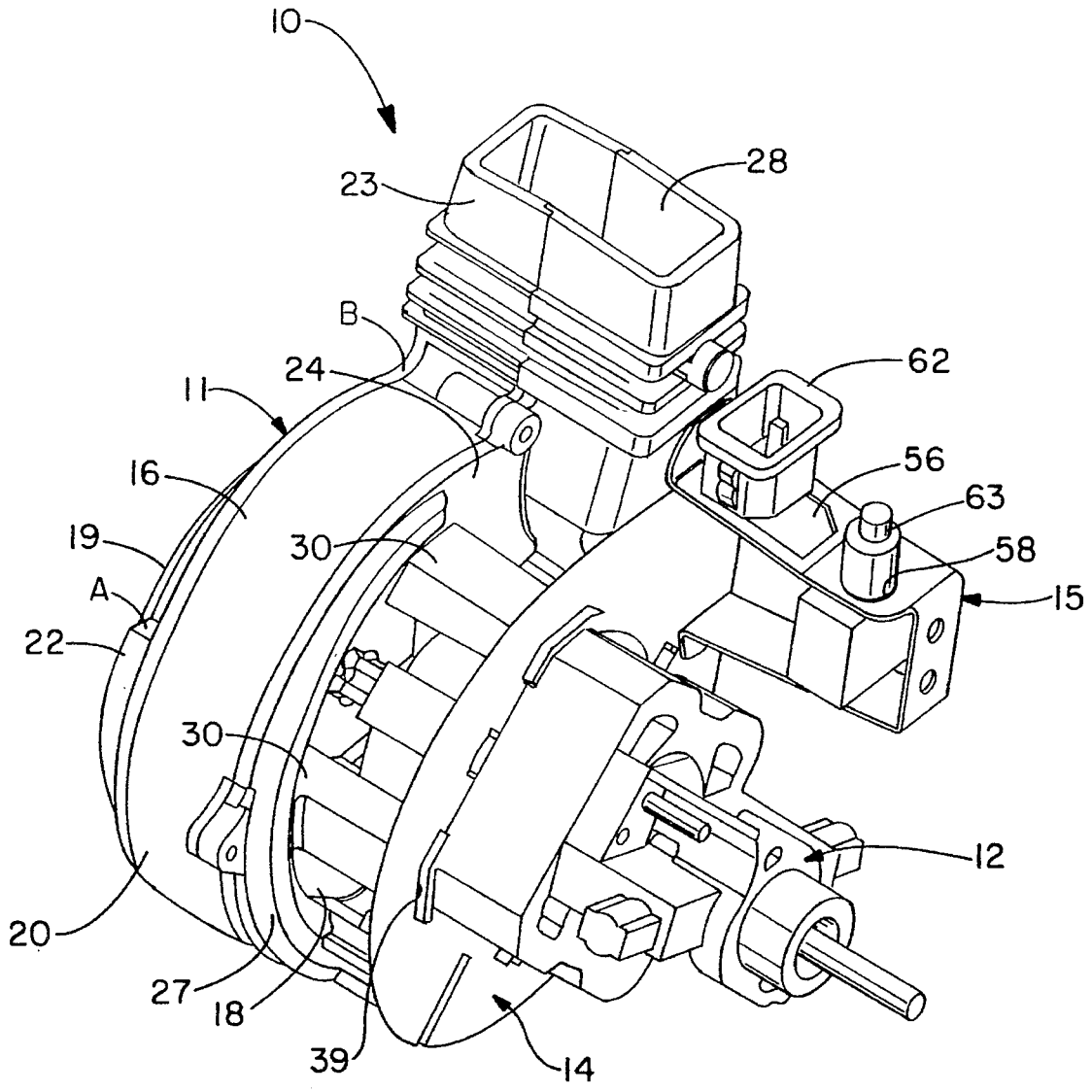
FIG. 1 is a perspective view of the motor/fan assembly according to the invention.

With reference now to the drawings and more particularly to FIG. 1, it can be seen that a motor/fan assembly according to the invention is designated generally by the numeral 10. As shown, the motor/fan assembly 10 is comprised generally of a fan housing 11, which encloses a fan (not shown), a motor assembly 12, a shroud/baffle unit 14, and a component strap 15. As can be seen, the shroud/baffle unit 14 is assembled to the housing 11 between the motor assembly 12 and the housing 11, while the component strap 15 is mounted to the shroud 14 opposite the housing 11.

It can be seen that the fan housing 11 generally comprises a main housing portion 16 and an end bracket 18. As shown, the main housing portion 16 has a generally circular end wall 19 and a circumferential side wall 20 which extends generally orthogonally from the end bracket 18 at the outer periphery thereof. A volute expansion chamber 22 is disposed in the end wall 19 adjacent to the outer periphery thereof. The expansion chamber 22 is tapered and, as such, the depth of the chamber 22 increases gradually clockwise from a Point A to a Point B. Accordingly, the chamber 22 is deepest at Point B where the chamber 22 terminates in an exhaust port 23 which interrupts the circumferential side wall 20 and extends outwardly therefrom.

The end bracket 18 comprises a generally disk-shaped plate portion 24 having a central shaft aperture 26. The end bracket 18 is adapted to engage the main housing portion 16 in a mating fashion. Accordingly, the end bracket 18 includes a tapered volute expansion chamber 27 similar to that of the main housing portion 16. Similarly, the expansion chamber 27 of the end bracket 18 terminates in an exhaust port portion 28. Additionally, a plurality of motor mounting stanchions 30 extend outwardly from a side of the plate portion 24 opposite the expansion chamber 27.

Figure 2:
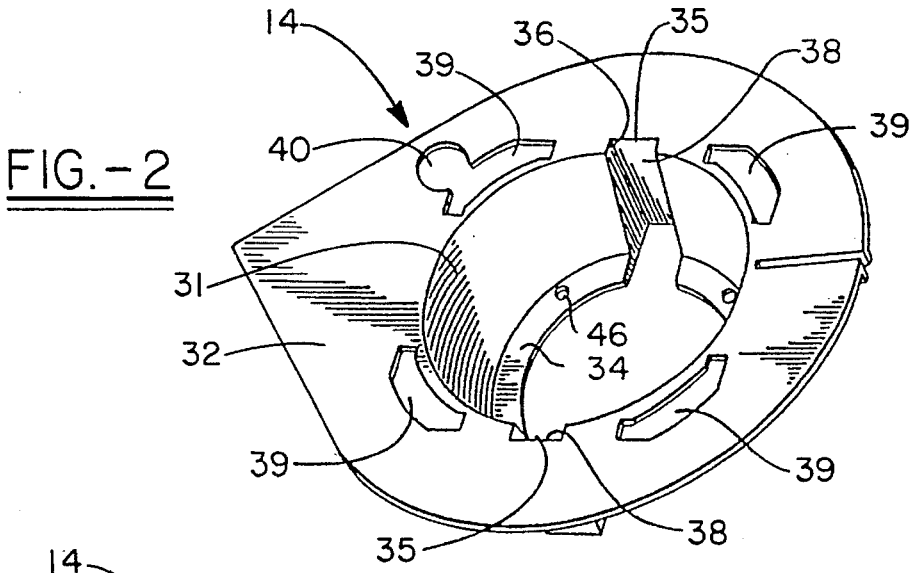
FIG. 2 is a perspective top view of the shroud/baffle unit of the invention.
Figure 3:
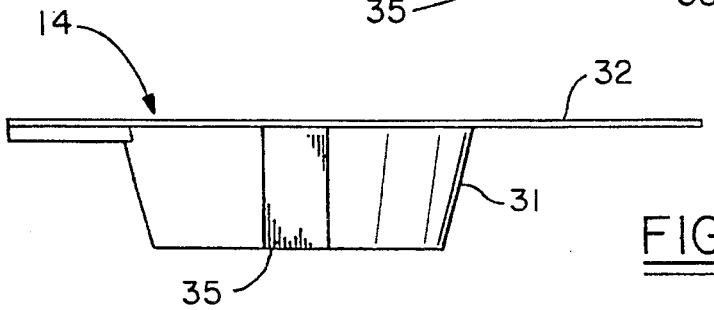
FIG. 3 is an elevational side view of the shroud/baffle unit of FIG. 2.
Figure 4:
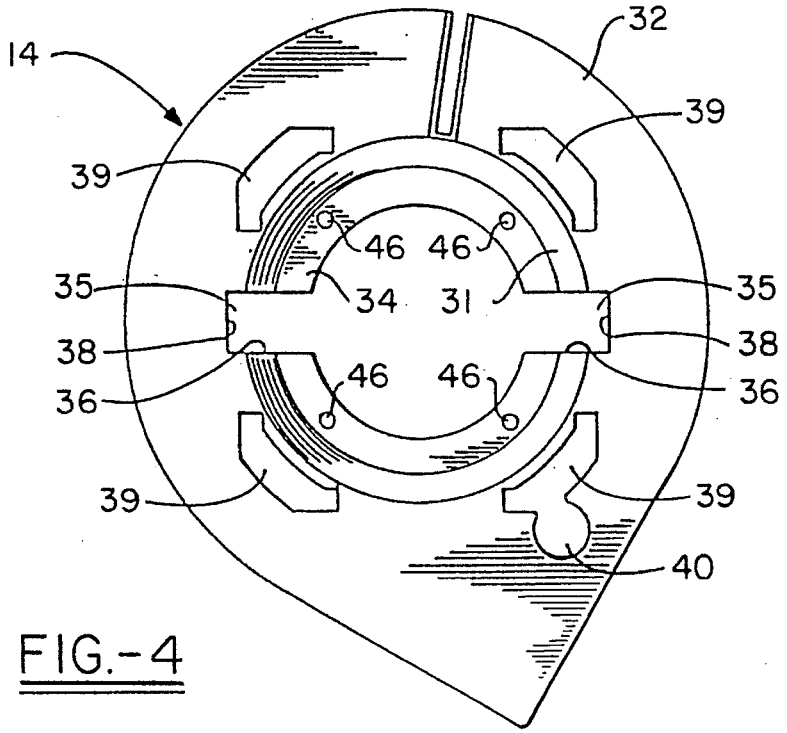
FIG. 4 is a bottom plan view of the shroud/baffle unit.
Figure 5:
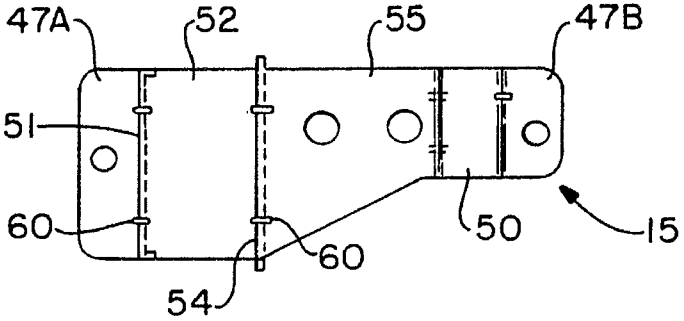
FIG. 5 is a top plan view of the component strap according to the invention.
Figure 6:
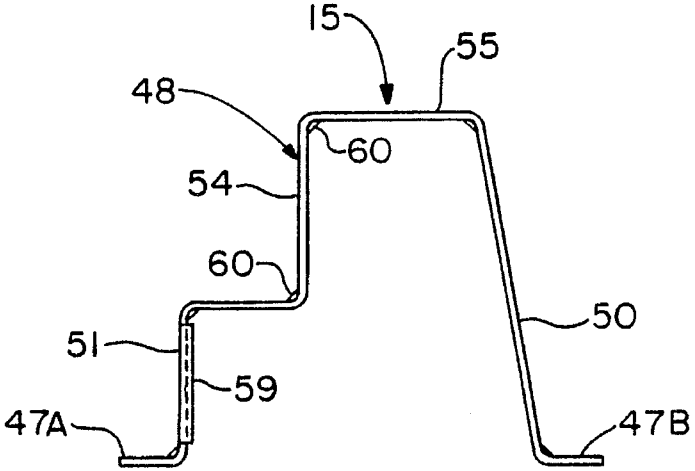
FIG. 6 is an elevational side view of the component strap of FIG. 5.
Figure 7:
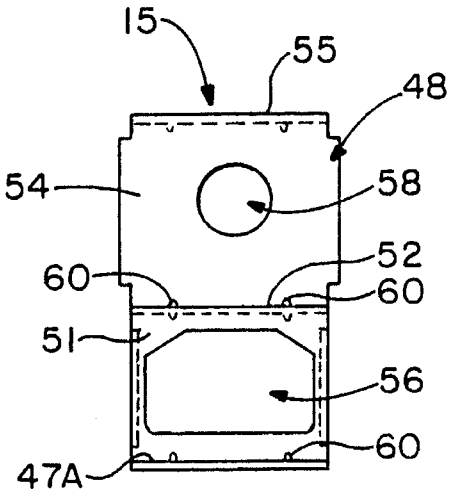
FIG. 7 is an elevational left end view of the component strap of FIG. 6.
Figure 8:
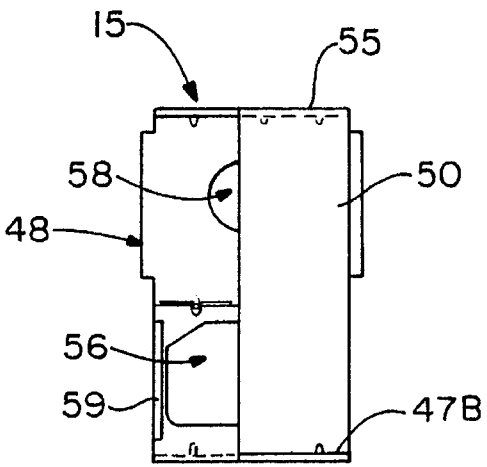
FIG. 8 is an elevational right end view of the component strap of FIG. 6.

Referring now to FIGS. 2–4, the shroud/baffle unit 14 comprises a frusto-conical side wall portion 31, which has an outwardly directed base flange 32 around the outer periphery of the base of the frustum. Similarly, a smaller inturned flange 34 is disposed around the inner periphery of the sidewall 31 at the top of the frustum. As shown, the sidewall 31 is interrupted about its circumference by a pair of diametrically opposed motor housings receiving recesses 35. Each recess 35 is defined by a generally rectangular indentation 36 in both the sidewall 31 and the flanges 32 and 34. The indentations 36 form a recess wall 38 which is disposed orthogonally to the flange 32. In addition to the recesses 35, the base flange 32 includes a plurality of motor stanchion apertures 39 which are equally spaced around a common radius. For reasons which will become apparent as the description continues, the apertures 39 are of a shape which closely approximates that of the motor mounting stanchions 30 of the housing end bracket 18. It should be noted that at least one of the apertures 39 includes an additional circular recess portion 40 for mounting the component strap 15, yet to be described. As can be seen, the in-turned flange 34 includes a plurality of fastener apertures 46 which are disposed at equal intervals along a common radius.

With reference to FIGS. 5–8 it can be seen that a component strap 15, according to the invention, comprises a continuous strap of metal or other appropriate material which is formed into a bracket member having a plurality of distinct surfaces. Specifically, the strap 15 includes a pair of opposed mounting flanges 47A and 48B which extend outwardly to form the base of the strap 15. The strap is bent at each of the mounting flanges 47 to form first and second side walls 48 and 50 respectively. As shown, the first side wall 48 comprises a generally vertical first portion 51, and a generally vertical second portion 54 which is orthogonal to the second portion 52. As is perhaps best seen in FIG. 6, the second wall 50 extends obliquely upward from the mounting flange 47B over the same vertical distance as the first wall 48, and terminates, at its upper extremity, in a top wall 55. The top wall 55 extends obliquely from the second wall 50 and serves as a bridge between the second wall 50 and the second portion 54 of the first wall 48. As is apparent from FIGS. 5 and 8, the strap 15 is of an irregular shape, that is, the second wall 50 is considerably more narrow than the first wall 48. The irregular shape and plural bends serve to provide a sturdy mounting surface for vacuum cleaner interfaces while using minimal amounts of light weight material.

A power receptacle mounting aperture 56 is disposed in the first portion 51 of the first wall 48. Similarly, a switch mounting aperture 58 is provided in the second portion 54 of the first wall 48. It should be noted that the strap 15 may be provided with reinforcing tabs 59 adjacent to the apertures 56 and 58. The tabs 59 may be bent so as to impart an increased degree of rigidity to the strap 15 at the component mounting locations. The strap 15 may further include corner supports 60 at the bends which define the various walls and wall portions. Those skilled in the art will recognize that the strap 15 may be manufactured in a variety of shapes having a variety of component mounting locations and/or fastener apertures to provide for flexibility in use in a variety of applications.

The motor/fan assembly 10 is assembled by mounting a rotating fan member in the housing 11. The fan motor may be a conventional rotating fan, or preferably a molded plastic impeller fan having an improved strength to material ratio such as that disclosed in U.S. application Ser. No. 08/508,226 by the inventor herein and assigned to the assignee of the present invention. Such impeller fans utilize a V-buttress blade-to-backing plate transition, which increases blade strength while utilizing less material. The end bracket 18 closes the housing 11, and the shroud/baffle unit 14 is mounted thereon. Specifically, the motor mounting stanchions 30 are received in the motor stanchion aperture 39 at the base flange 32. A motor assembly 12 such as a conventional DC motor is received in the shroud/baffle unit 14 and mounted to the stanchions 30. The motor shaft penetrates the end bracket 18 by way of the shaft aperture 26 and engages the fan member. The shroud/baffle unit 14 and motor assembly 12 may be secured to the housing 11 and/or to one another by way of the fastener apertures 46 of the shroud 14. The component strap 15 is secured to the shroud/baffle unit 14 and/or the end bracket 18 as shown. As seen in FIG. 1, the mounting flange 47A is mounted to the end bracket 18 and the mounting flange 47B is mounted to the shroud/baffle unit 14 and covers the circular recess portion 40 that extends from one of the apertures 39. A power receptacle 62 and switch 63 may then be mounted to the strap 15 as may other accessory components, as desired. In this regard it is contemplated that interconnects between the field windings, terminated on a terminal board may be provided for the component interfaces.

The manner in which the invention accomplishes the objects thereof should now be apparent. Specifically, the configuration of the blades of the rotating fan and the clearance afforded in the design of the end bracket 18 increase fan performance without sacrificing the debris ingestion capability of the assembly. Further, the design of the shroud/baffle unit 14 separates the inlet and exhaust plenums of the ventilating fan of the motor 12 thereby allowing the motor 12 to run cooler and increasing the reliability of the motor components. At the same time the performance level of the motor is increased above historical levels. The above described features combine to produce a motor/fan assembly 10 which is highly flexible for use with a variety of vacuum cleaner types while being efficient, reliable, lightweight and inexpensive.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. In a motor/fan assembly for a vacuum cleaner or the like, the motor/fan assembly having a rotating fan member mounted in a housing and a motor engaged with said rotating fan, the improvement comprising:

an end bracket portion of the housing, said end bracket portion having a volute expansion chamber;

a shroud/baffle unit interposed between the motor and said end bracket, and surrounding the motor; and a component strap mounted to said shroud/baffle unit and said end bracket for carrying a variety of plurality cleaner components.

2. The improvement in a motor/fan assembly according to claim 1, wherein said volute expansion chamber of said end bracket terminates in an exhaust port.

3. The improvement in a motor/fan assembly according to claim 1, wherein said end bracket comprises at least one shaft aperture.

4. The improvement in a motor/fan assembly according to claim 1, wherein said end bracket comprises at least one motor mounting stanchion.

5. The improvement in a motor/fan assembly according to claim 1 wherein said shroud/baffle unit comprises:

a frusto-conical sidewall having opposed ends;

a base flange surrounding the outer periphery of one of said opposed ends of said sidewall; and an in-turned flange surrounding the inner periphery of another of said opposed ends of said sidewall.

6. The improvement in a motor/fan assembly according to claim 5, wherein said shroud/baffle unit further comprises at least one motor housing receiving recess in said side wall.

7. The improvement in a motor/fan assembly according to claim 5, wherein said shroud/baffle unit further comprises at least one motor stanchion aperture in said base flange.

8. The improvement in a motor/fan assembly according to claim 1 wherein said component strap comprises:

at least one mounting flange;

at least one side wall extending obliquely from said at least one mounting flange; and at least one component mounting aperture in said at least one side wall.

9. A shroud/baffle unit for a motor/fan assembly, said shroud/baffle unit comprising:

a frusto-conical side wall portion having a pair of opposed ends and having at least one motor housing receiving recess;

a base flange surrounding the outer periphery of one of said opposed ends of said side wall; and an in-turned flange surrounding the inner periphery of another of said opposed ends of said side wall.

10. A shroud/baffle unit according to claim 9 further comprising at least one motor stanchion aperture in said base flange.

11. A component mounting strap for a motor/fan assembly, comprising:

at least one mounting flange mountable to a motor/fan assembly;

at least one side wall extending obliquely from said at least one mounting flange; and at least one component mounting aperture in said at least one side wall.

12. The component mounting strap according to claim 11, wherein said at least one component mounting aperture carries at least one vacuum cleaner interface.

13. The component mounting strap according to claim 12, further comprising:

a bridge wall extending obliquely from said at least one side wall;

a second side wall extending from said bridge wall; and a second mounting flange mountable to the motor/fan assembly.

* * * * *